US006137098A

United States Patent [19]

Moseley et al.

[11] Patent Number: 6,137,098

[45] Date of Patent: Oct. 24, 2000

[54] MICROWAVE POPCORN BAG WITH CONTINUOUS SUSCEPTOR ARRANGEMENT

[75] Inventors: Jennifer D. Moseley, LaFontaine; John C. Little, Fort Wayne, both of Ind.; Richard W. Narramore, Centerville, Ohio; Charles A. Main, Cincinnati, Ohio; Alan Paul Berens, Jr., Centerville, Ohio

[73] Assignees: Weaver Popcorn Company, Inc., Van Buren, Ind.; Miami Packaging Incorporated, Middleton, Ohio

[21] Appl. No.: 09/162,647

[22] Filed: Sep. 28, 1998

[51] Int. Cl.[7] ..... H05B 6/80

[52] U.S. Cl. ..... 219/727; 219/730; 426/107; 426/234

[58] Field of Search ..... 219/725, 727, 219/728, 730, 759; 426/103, 107, 113, 234; 383/95

[56] References Cited

U.S. PATENT DOCUMENTS

| | | | |
|---|---|---|---|
| Re. 34,683 | 8/1994 | Maynard et al. | 219/703 |
| 2,595,708 | 5/1952 | Salfisberg | 206/46 |
| 2,633,284 | 3/1953 | Moffett et al. | 229/2.5 |
| 3,873,735 | 3/1975 | Chalin et al. | 426/87 |
| 3,973,045 | 8/1976 | Brandberg et al. | 426/110 |
| 4,450,180 | 5/1984 | Watkins | 426/107 |
| 4,548,826 | 10/1985 | Watkins | 426/394 |
| 4,691,374 | 9/1987 | Watkins et al. | 383/104 |
| 4,806,371 | 2/1989 | Mendenhall | 426/113 |
| 4,808,421 | 2/1989 | Mendenhall et al. | 426/107 |
| 4,851,246 | 7/1989 | Maxwell et al. | 426/107 |
| 4,874,620 | 10/1989 | Mendenhall et al. | 426/113 |
| 4,883,936 | 11/1989 | Maynard et al. | 219/10.55 |
| 4,890,439 | 1/1990 | Smart et al. | 53/410 |
| 4,970,358 | 11/1990 | Brandberg et al. | 219/10.55 |
| 4,973,810 | 11/1990 | Brauner | 219/10.55 |
| 5,019,359 | 5/1991 | Kutner et al. | 422/294 |
| 5,044,777 | 9/1991 | Watkins et al. | 383/100 |
| 5,075,119 | 12/1991 | Mendenhall | 426/113 |
| 5,081,330 | 1/1992 | Brandberg et al. | 219/10.55 |
| 5,171,594 | 12/1992 | Barbitt | 426/107 |
| 5,175,031 | 12/1992 | Ochocki | 428/34.2 |
| 5,195,829 | 3/1993 | Watkins et al. | 383/100 |
| 5,211,975 | 5/1993 | Mendenhall et al. | 426/107 |
| 5,217,768 | 6/1993 | Walters et al. | 428/35.8 |
| 5,294,765 | 3/1994 | Archibald et al. | 219/727 |
| 5,302,790 | 4/1994 | Turpin | 219/727 |
| 5,306,512 | 4/1994 | Blamer | 426/107 |

(List continued on next page.)

FOREIGN PATENT DOCUMENTS

| | | |
|---|---|---|
| 81544 | 12/1956 | Denmark . |
| 2202118 | 9/1988 | United Kingdom . |
| WO 96/04768 | 2/1996 | WIPO . |

*Primary Examiner*—Tu Ba Hoang
*Attorney, Agent, or Firm*—Baker & Daniels

[57] ABSTRACT

The present invention involves a microwave popcorn bag adapted to contain a plurality of popcorn kernels to be heated and popped within an interior region of the bag by the application of microwave energy. The microwave popcorn bag is formed from a sheet of material comprising: a first paper stock layer having a top edge and a bottom edge; a second paper stock layer disposed over said first paper stock layer; a carrying layer disposed between said first and second paper stock layer, said carrying layer continuously extending between said top and bottom edges; and a microwave susceptor region disposed on the carrying layer. A top seal portion and a bottom seal portion are disposed proximate the respective top and bottom edges. The present invention also provides a method of manufacturing microwave popcorn bags including the steps of: providing sheet stock material with a continuous strip of carrying material and at least a portion of the carrying material includes susceptor material; cutting the sheet stock material into individual sheets at locations which provides for the susceptor material being positioned generally in the middle of the individual sheets; applying sealing adhesive to the individual sheets at predetermined locations; folding the individual sheets into bags; and sealing the bags by activating the sealing adhesive.

7 Claims, 3 Drawing Sheets

U.S. PATENT DOCUMENTS

| | | | |
|---|---|---|---|
| 5,317,118 | 5/1994 | Brandberg et al. | 219/727 |
| 5,326,576 | 7/1994 | Zuege | 426/107 |
| 5,350,904 | 9/1994 | Kemske et al. | 219/730 |
| 5,399,022 | 3/1995 | Sheets | 383/103 |
| 5,424,517 | 6/1995 | Habeger, Jr. et al. | 219/107 |
| 5,460,839 | 10/1995 | Archibald | 426/107 |
| 5,464,969 | 11/1995 | Miller | 219/735 |
| 5,474,383 | 12/1995 | Zuege et al. | 383/121 |
| 5,679,278 | 10/1997 | Cox | 219/730 |
| 5,783,010 | 7/1998 | Yannuzzi, Jr. | 426/107 |
| 5,814,382 | 9/1998 | Yannuzzi, Jr. | 428/34.3 |

MICROWAVE POPCORN BAG WITH CONTINUOUS SUSCEPTOR ARRANGEMENT

FIELD OF THE INVENTION

The invention generally relates to the field of cooking articles for microwave ovens. More specifically, the field of the invention is that of microwave popcorn bags.

DESCRIPTION OF THE RELATED ART

Various items of food have been adapted for cooking in microwave ovens, and popcorn has become one of the most popular microwavable foods. Early attempts at cooking popcorn in a microwave oven involved using a shape similar to paper lunch bag with a rectangular bottom. However, this type of bag did not work well with allowing the popcorn kernels to expand and fill the bag. Also, often many kernels were left unpopped because of inadequate conveyance of heat to all the popcorn kernels. New bags were then developed which made two major changes.

The first change was in the shape of the bag itself, going from the rectangular bottom to a pillow shape, pinch bottom which provides more room for the popcorn kernels to expand and fill the bag. The pillow shaped bag is generally comprised of a front and back panel which are connected by lengthwise gussets and which are sealed on the top and bottom. The bottom seal must be sufficient to withstand the pressures of heating and popping the popcorn and oil charge, although the top seal may have some weakness to allow for venting of the bag during popping, and for easy manual opening by the consumer pulling apart the top of the panels.

The second change involved increasing the heat present in the bag by adding a microwave susceptor patch with the bag, located over the location of the popcorn and oil charge within the bag. Also, to prevent leakage of oil from the bag, the paper layers include a grease resistant layer to prevent melted oil from soaking the outer paper layers of the bag. The construction of the bag includes two plies of paper, with the microwave susceptor patch being located and registered between the two plies. The microwave susceptor material was thus located between the grease resistant layer on the inside of the bag and the printing layer located on the outside of the bag. Both of these changes improved the performance of microwave popcorn bags.

These changes also had drawbacks. The pillow shaped bag, while better adapted to expand during the initial popping of the bag, ultimately restricts the amount of space available within the interior of the bag. Also, locating and registering the microwave susceptor material at the appropriate location on the bag stock creates an additional manufacturing step, slowing and complicating the manufacturing process. The proper location of the susceptor material relative to the popcorn kernels is crucial to achieving high popping efficiency by providing adequate amounts of heat to the popcorn kernels located within the interior space of the bag.

Advances in the pillow shaped bag attempt to create a rectangular bottom portion on the pillow shaped bag as a result of the popping. By glueing together certain portions of the bottom and top portions of the bag, the bottom and top portion tend to form a flatter, more rectangular end compared to a pillow shaped bag which is only glued at the end seals. Several different arrangements of gluing are used, having varying locations and amounts of glue for creating the flatter, rectangular ends. However, the microwave popcorn industry still desires a bag which when popped provides improved internal volume, accomplished with the flatter, rectangular ends, while minimizing the material and manufacturing costs.

SUMMARY OF THE INVENTION

The present invention involves the position and manufacture of a microwave susceptor material in a microwave popcorn bag. A continuous strip of material carries the susceptor material, which is located between paper layers of the microwave popcorn bag. The substantially continuous nature of the susceptor material generates heat more evenly through the microwave popcorn bag than conventional patches. Also, the need for the manufacturing step of locating and securing the susceptor patch on a panel of the bag is eliminated with the present invention. This allows much faster production techniques while providing improved cooking characteristics.

Another aspect of the invention relates to the incorporation of the substantially continuous strip for carrying the susceptor material into the bag paper. The strip of polymer material carries susceptor material to be located on a region of the front panel of the bag, and the susceptor material runs lengthwise across substantially all but the sealed ends of the bag stock. With this arrangement, the complication and expense of precisely registering the susceptor patch is avoided, increasing the speed and flexibility of the manufacturing process. Also, because of the increased surface coverage of the continuous strip as compared to conventional susceptor patch arrangements, a lower gauge susceptor material may be used, which has the additional benefit of controlling the temperature of the bag as it is heated by impingement of microwave energy. Further, the continuous strip may also have a pattern of susceptor material which can be further configured to control bag temperature. Proper control of bag temperature allows the maximum percentage of popcorn kernels to pop, while minimizing the amount of burnt kernels.

The present invention, in one form, involves a microwave popcorn bag adapted to contain a plurality of popcorn kernels to be heated and popped within an interior region of the bag by the application of microwave energy. The microwave popcorn bag formed from a sheet of material comprising: (1) a first paper stock layer having a top edge and a bottom edge; (2) a second paper stock layer disposed over said the paper stock layer; (3) a carrying layer disposed between the paper stock layers, the carrying layer continuously extending between the top and bottom edges; and (4) a microwave susceptor material with the carrying layer, the susceptor material when exposed to microwave radiation providing heating to substantially all portions of the interior popping space. Top seal and bottom seal portions are disposed on one of the paper layers proximate the respective top and bottom edges. The microwave susceptor material is disposed in a position removed from the top and bottom seal portions. The microwave susceptor material covers about sixty percent of the width of a front panel formed by the folding of the sheet material. The microwave popcorn bag is folded to create gussets with panels and edges, with a mitre located proximate the bottom seal. The mitre includes an edge strip extending from about the bottom seal along a gusset edge for a length corresponding to about the length of a gusset panel, and includes a cross strip extending for a length corresponding to about the length of the gusset panel. The cross strip intersects the edge strip at about the midpoint of the edge strip. The microwave susceptor material is about 36 gauge.

The present invention, in another form, involves a method of manufacturing microwave popcorn bags, comprising the steps of: (1) providing sheet stock material with a continuous strip of carrying material, at least a portion of the carrying material including susceptor material; (2) cutting the sheet stock material into individual sheets at locations which positions the susceptor generally in the middle of the individual sheets; (3) applying sealing adhesive to the individual sheets at predetermined locations; (4) folding the individual sheets into bags; and (5) sealing the bags by activating the sealing adhesive.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Figure 1:
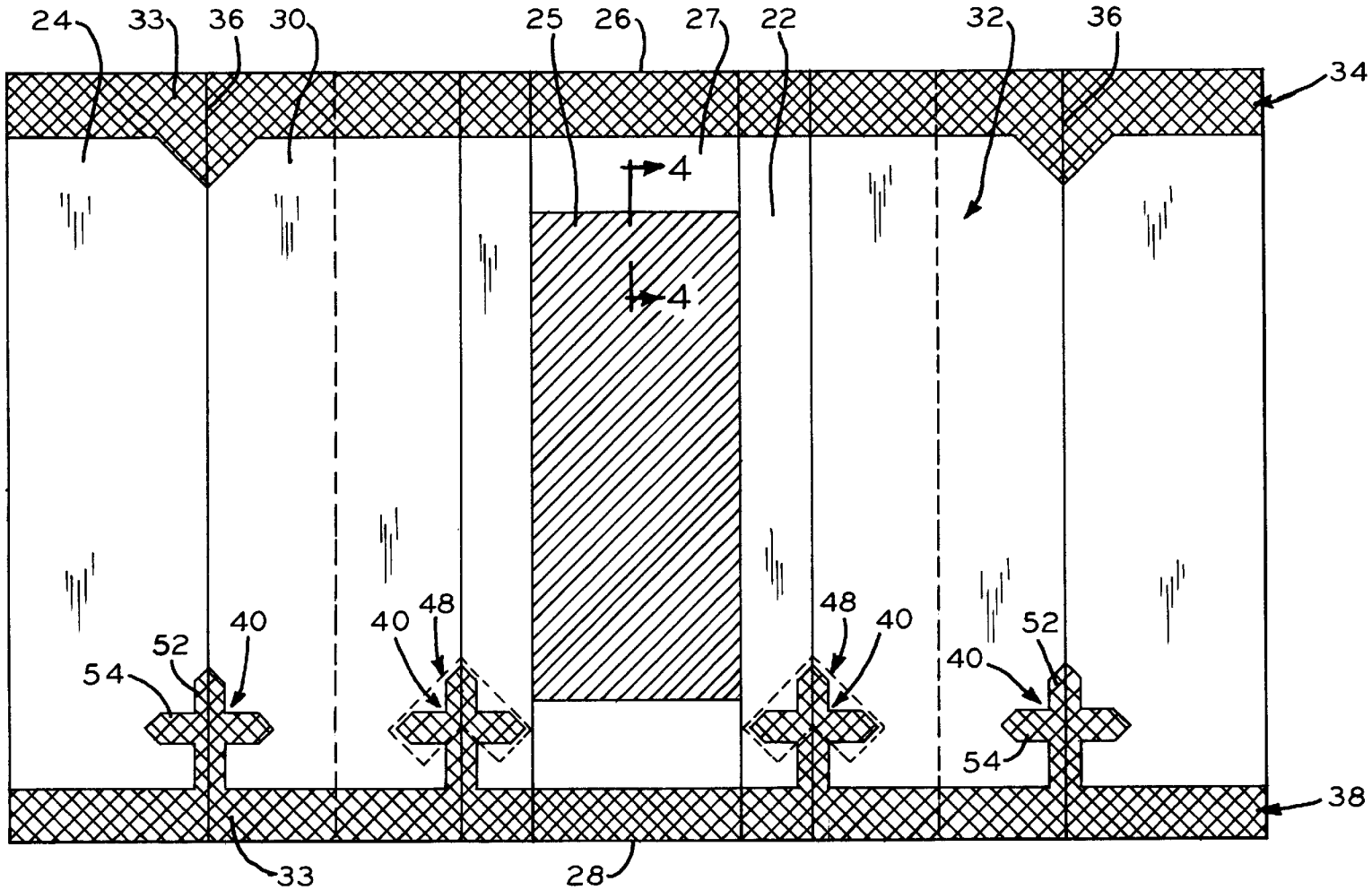
FIG. 1 is a plan view of a microwave popcorn bag of the present invention previous to folding and sealing.

Corresponding reference characters indicate corresponding parts throughout the several views. Although the drawings represent embodiments of the present invention, the drawings are not necessarily to scale and certain features may be exaggerated in order to better illustrate and explain the present invention. The exemplification set out herein illustrates an embodiment of the invention, in one form, and such exemplifications are not to be construed as limiting the scope of the invention in any manner.

DESCRIPTION OF THE PRESENT INVENTION

The embodiment disclosed below is not intended to be exhaustive or limit the invention to the precise form disclosed in the following detailed description. Rather, the embodiment is chosen and described so that others skilled in the art may utilize its teachings.

The mitre design of the present invention is shown previous to the folding of the microwave popcorn bag in FIG. 1. Bag 20 comprises a sheet of material which includes front panel 22 and back panel 24. Front panel 22 includes microwave susceptor material 25 to enhance the heating of popcorn kernels within the bag when subjected to microwave energy. In the disclosed embodiment, microwave susceptor material 25 is located nearly continuously from top edge 26 to bottom edge 28. Back panel 24 is initially two portions which are connected together by a manufacturer's joint in a manner well known in this art. Gussets 30 and 32 connect front and back panels 22 and 24 and are folded at the center.

Previous to folding the sheet of material, adhesive material 33 is applied at selected areas of the material. Adhesive material forms both top edge seal 34 and top mitre 36 along top edge 26, and bottom edge seal 38 along bottom edge 28. In the exemplary embodiment, top edge seal 34 extends about 1.0625 inches from top edge 26, and bottom edge seal 38 extends about 0.75 inches above bottom edge 28. That adhesive material also forms the mitre design of the present invention at mitres 40. Each mitre 40 includes edge strip 52 extending from about the bottom seal along a gusset edge for a length corresponding to about the length of a gusset panel, and includes cross strip 54 extending for a length corresponding to about the length of the gusset panel. Cross strip 54 intersects edge strip 52 at abut the midpoint of edge strip 52. The adhesive material is first dried on the stock material before the stock material is rolled together. The adhesive material is also heat activated, and the roto gravure method of applying the heat seal adhesive has been used for attaining better accuracy, while the flexo graphic method may alternatively be used. Such adhesive material may include such substances as polyvinyl acetate homopolymer emulsions or polyvinyl acetate homopolymer emulsions with additives to enhance machinability according to specific situations and requirements. Alternatively, other adhesives may be used which have similar qualities such as creating strong bonds with a minimum application coating weight and being able to be sealed within a wide range of temperatures, which are beneficial in accomplishing the objectives of the present invention. For visibility purposes, the adhesive material may be colored with a dye.

As shown in FIG. 1, front panel 22 includes region 25 of microwave susceptor material extending a substantial portion of the length of front panel 22, allowing for a lesser gauge of susceptor material, e.g. 36 gauge rather than conventionally used 48 gauge susceptor material. Region 25 is carried on a continuous strip of polymer material so that region 25 need not be registered on front panel 22. Also, in the exemplary embodiment of the invention, region 25 is about 3.3125 inches in width, with front panel 22 being about 5.5 inches. Thus, region 25 covers only about sixty percent (60%) of the width of front panel 22.

Instead of concentrating the heat generating susceptor material in a smaller region of the front panel, the arrangement of the present invention tends to distribute the heat generated by the susceptor material relatively evenly throughout the interior region of bag 20. Further, this arrangement reduces the amount of susceptor material needed, generally using less material over a greater area. The location of the popcorn kernels and its associated oil charge relative to the susceptor patch in prior art designs is critical for achieving high level of popping efficiency. With the arrangement of the present invention, the criticality of the location of the kernel and oil charge is reduced, as the heat generated by the susceptor material reaches substantially all of the bag interior.

Figure 4:
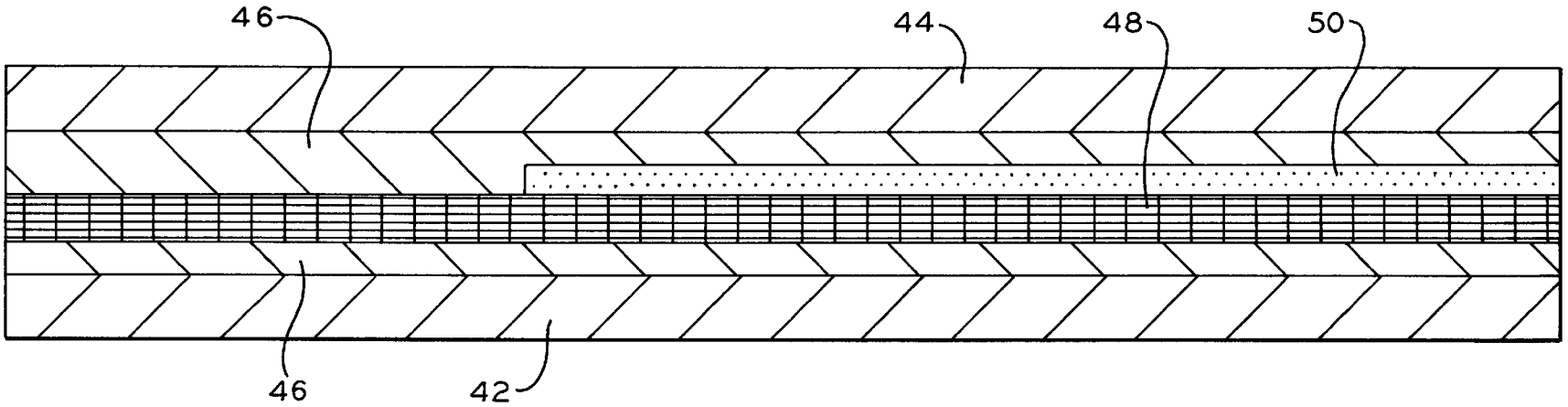
FIG. 4 is a cross-sectional view of the layers of the microwave popcorn bag material forming the sheet stock taken along view lines 4—4 of FIG. 1.

The laminar structure and configuration of the sheet material is shown in cross-section in FIG. 4. Generally, the stock material includes inner layer 42 (which in the exemplary embodiment is made from 23# basis bleached or natural paper stock), outer layer 44 (which in the exemplary embodiment is made from 23# basis bleached or natural paper stock), and a connecting layer 46 of adhesive (which in the exemplary embodiment is made from high performance formulated copolymer emulsion adhesive). For the portions of the stock material containing strip region 27, an additional layer of strip material 48 (which in the exemplary embodiment includes polyester material) runs continuously from top edge 26 to bottom edge 28.

On selected locations of strip region 27, an additional layer of microwave susceptor material 50 (which is the exemplary embodiment includes aluminum material) is deposited on strip material 48. While FIG. 4 shows microwave susceptor material 50 as a separate and distinct laminar layer, alternatively suseptor material 50 and strip material 48 may fuse together and become single laminar layer. An additional alternative design includes having susceptor material 50 comprise flakes or particles of suitable microwave reactive matter which may then be embedded in portions of strip material 48, possibly in patterns for enhancing the heating of the interior of bag 20. Susceptor material 50 is generally not deposited adjacent bottom edge 28 or top edge 26 so that the adhesive seals at those locations are not breached by the heat generated by susceptor material 50.

While popcorn generally pops at approximately 380° F., with current materials the bag reaches approximately 450° F. before the popcorn kernels become sufficiently heated to pop. Consequently, strip material 48 can be any material capable of withstanding the temperatures required to achieve popcorn popping, as long as it can maintain its ability to carry susceptor material 50. Alternatively, susceptor material 50 could comprise a sufficiently flexible material such that no strip material 48 is required to carry susceptor material 50.

Bags 20 are formed by a method which includes providing the sheet stock material in the form of a conventional roll of paper, cutting the sheet stock into individual sheets, applying sealant, folding the bags, and activating the sealant. The sheet stock material includes a continuous strip of carrying material, and at least a portion of the carrying material includes susceptor material. The susceptor material may be disposed at predetermined locations or a continuous susceptor may be printed at predetermined locations with a coating that will defuse the susecptor material, such that, when the susceptor material is exposed to microwave radiation, it provides heat to specific areas within the bag. Cutting the stock material into individual sheets is accomplished at locations which positions the susceptor material generally in the middle of the individual sheets. Next, sealing sealing adhesive is applied to the individual sheets at predetermined locations then the individual sheets are folded into bags. Finally, the bags are sealed by activating the sealing adhesive.

Figure 2:
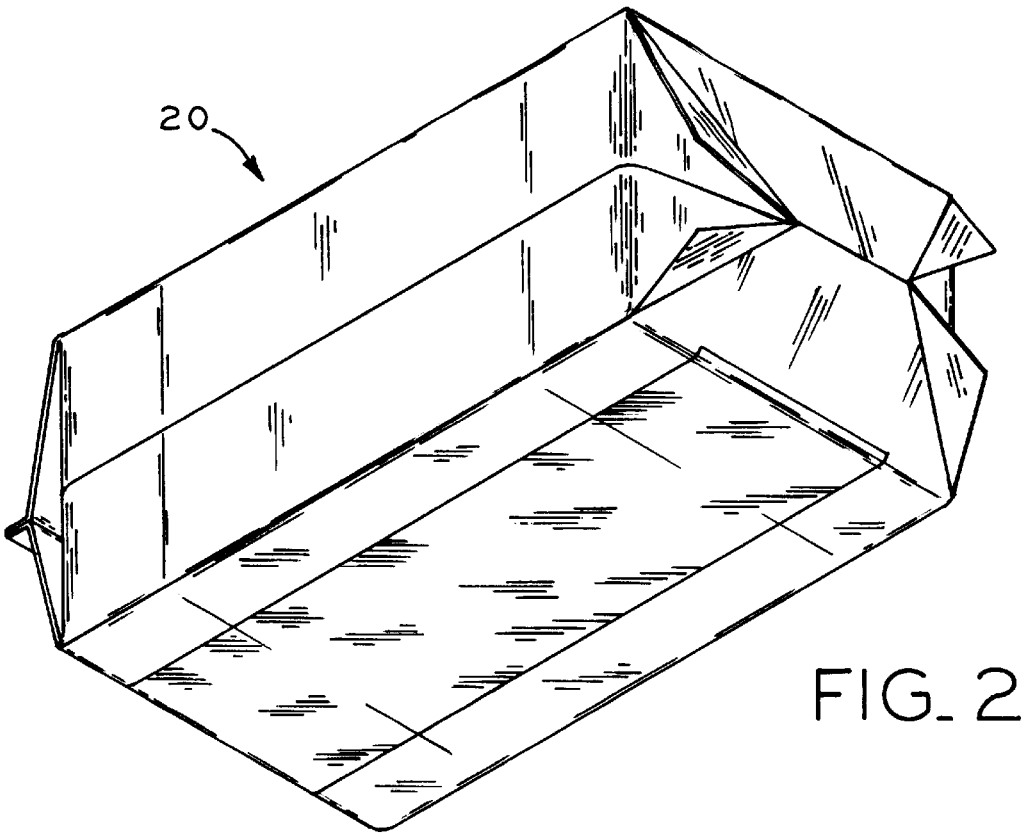
FIG. 2 is a perspective view of the top end of a microwave popcorn bag of the present invention after the popping of popcorn kernels.
Figure 3:
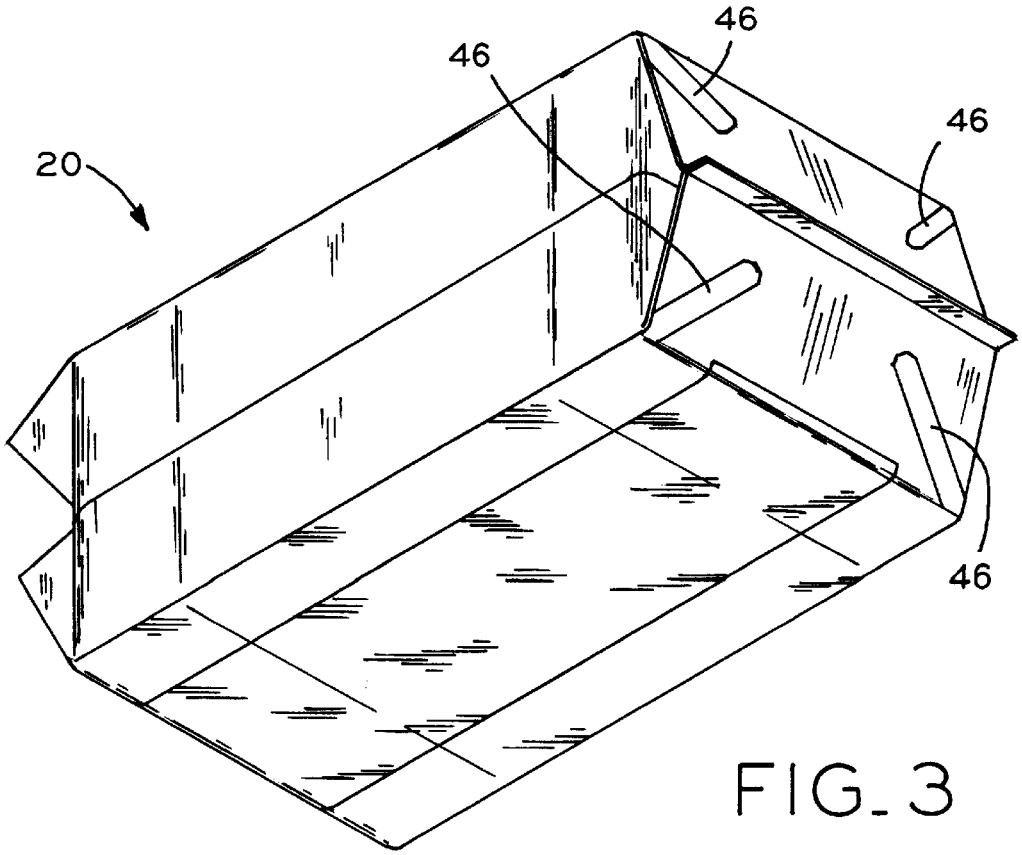
FIG. 3 is a perspective view of the bottom end of a microwave popcorn bag of the present invention after the popping of popcorn kernels.

After popping, bag 20 has the general configuration shown in FIGS. 2 and 3. Bottom edge seal 38 and bottom mitres 40 operate to "square off" the bottom portion of bag 20, forming a substantially rectangular bag bottom as shown in FIG. 3. Top edge seal 34 and top mitres 36 creates a substantial "squaring off" of the top portion of bag 20, which facilitates manual opening by pulling apart the portions of bag 20 bonded together by top edge seal 34 as shown in FIG. 2. Testing of the popped volumes of the bag of the present invention showed a significant increase in interior space compared to similarly sized bags using conventional designs. The resulting rectangular solid shape of the microwave popcorn bag maximizes the amount of interior room for popped kernels, so that the bag can contain the maximum possible amount of popped corn. Also, by limiting the amount of venting through the top edge popping efficiency is promoted because of the retention of heat with the additional benefit of maintaining the contact of airborne flavorings with the popped kernels.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A microwave popcorn bag adapted to contain a plurality of popcorn kernels to be heated and popped within an interior region of the bag by the application of microwave energy, said microwave popcorn bag formed from a sheet of material comprising:

a first paper stock layer having a top edge and a bottom edge;

a second paper stock layer disposed over said first paper stock layer;

a carrying layer disposed between said first and second paper stock layer said carrying layer continuously extending between said top and bottom edges; and a portion of said carrying layer including a microwave susceptor material with other portions of said carrying layer lacking said microwave susceptor material, wherein said portion of said carrying layer including said microwave susceptor material continuously extending at least between said top and bottom edges and said susceptor material when exposed to microwave radiation providing heating to substantially all portions of the interior region of the bag.

2. The microwave popcorn bag of claim 1 further comprising a top seal portion and a bottom seal portion disposed on one of said first and second paper stock layers proximate said top and bottom edges, respectively.

3. The microwave popcorn bag of claim 2 wherein said microwave susceptor material is disposed in a position removed from said top seal portion and said bottom seal portion.

4. The microwave popcorn bag of claim 2 wherein said microwave susceptor material covers about sixty percent of the width of a front panel formed by folding the sheet material of said bag into a rectangular solid shape.

5. The microwave popcorn bag of claim 2 wherein the sheet of material is folded to create gussets with panels and edges, further comprising a mitre located proximate said bottom seal portion, said mitre including an edge strip extending from about said bottom seal portion along a gusset edge for a length corresponding to about the length of a gusset panel, said mitre including a cross strip extending for a length corresponding to about the length of the gusset panel, said cross strip intersecting said edge strip at about the midpoint of said edge strip.

6. The microwave popcorn bag of claim 1 wherein said microwave susceptor material is about 36 gauge.

7. A method of manufacturing microwave popcorn bags, comprising the steps of:

providing sheet stock material layers with a continuous strip of carrying material layer disposed between said sheet stock material layers and continuously extended between the top and bottom edges of said sheet stock material layers a portion of the carrying material layer including susceptor material with other portions of the carrying material layer lacking said microwave susceptor material, wherein said portion of said carrying layer including said microwave susceptor material continuously extending at least between said top and bottom edges and the susceptor material which when exposed to microwave radiation provides heat to surrounding areas, the susceptor material being disposed at predetermined locations;

cutting the sheet stock material into individual sheets at locations which provides for the susceptor material being positioned generally in the middle of the individual sheets;

applying sealing adhesive to the individual sheets at predetermined locations;

folding the individual sheets into bags; and sealing the bags by activating the sealing adhesive.

* * * * *

UNITED STATES PATENT AND TRADEMARK OFFICE

CERTIFICATE OF CORRECTION

PATENT NO : 6,137,098

DATED : October 31, 2000

INVENTOR(S) : Moseley, et al.

It is certified that error appears in the above-identified patent and that said Letters Patent is hereby corrected as shown below:

Claim 1,Column 6,Line 8- after stock delete "layer" and substitute therefor --layers--

Signed and Sealed this

Sixth Day of March, 2001

*Attest:*

Nicholas P. Godici

NICHOLAS P. GODICI

*Attesting Officer*

*Acting Director of the United States Patent and Trademark Office*